US005135157A

United States Patent [19]

Cruz

[11] Patent Number: 5,135,157

[45] Date of Patent: Aug. 4, 1992

[54] COMBINED ENVELOPE AND GREETING CARD

[76] Inventor: Gabriel Cruz, 37 S. Fifth Ave., Long Branch, N.J. 07740

[21] Appl. No.: 791,579

[22] Filed: Nov. 12, 1991

[51] Int. Cl.[5] ..... B42D 15/08

[52] U.S. Cl. ..... 229/92.8; 40/124.1; 229/314; 229/316

[58] Field of Search ..... 40/124.1, 539; 229/313, 229/314, 316, 92.1, 92.8

[56] References Cited

U.S. PATENT DOCUMENTS

| | | | |
|---|---|---|---|
| 1,227,215 | 5/1917 | Tanaka | 229/313 |
| 1,238,177 | 8/1917 | Moreland | 229/92.8 |
| 2,168,920 | 8/1939 | Wissmann | 229/92.8 |
| 3,259,304 | 7/1966 | Tichnor | 40/124.1 |
| 3,370,782 | 2/1968 | Hickman | 229/313 |
| 3,399,825 | 9/1968 | Kirchof | 229/92.8 |
| 3,606,138 | 9/1971 | Allison | 229/314 |
| 3,627,196 | 12/1971 | Smith | 229/314 |
| 3,982,689 | 9/1976 | Retrum | 229/313 |
| 4,140,317 | 2/1979 | Ramney | 229/72 |
| 4,182,060 | 1/1980 | Longenecker | 40/124.1 |

FOREIGN PATENT DOCUMENTS

| | | | |
|---|---|---|---|
| 2223425 | 11/1973 | Fed. Rep. of Germany | 229/92.8 |
| 2480196 | 10/1981 | France | 229/92.8 |

*Primary Examiner*—Stephen Marcus
*Assistant Examiner*—Christopher McDonald
*Attorney, Agent, or Firm*—Michael I. Kroll

[57] ABSTRACT

A combined envelope and greeting card is provided which consists of a greeting card configuration, a mechanism for sealing the greeting card configuration, so that it can be transformed into an envelope configuration to be properly addressed by an addresser and then mailed to an addressee and a mechanism for breaking the sealing mechanism, so that the envelope configuration can be transformed back into the greeting card configuration by the addressee.

9 Claims, 2 Drawing Sheets

COMBINED ENVELOPE AND GREETING CARD

BACKGROUND OF THE INVENTION

1. Field of the Invention

The instant invention relates generally to stationary supplies and more specifically it relates to a combined envelope and greeting card.

2. Description of the Prior Art

Numerous stationary supplies have been provided in prior art that are adapted to include separate envelopes and greeting cards which will be combined together when the greeting cards have to be mailed from one party to another. While these units may be suitable for the particular purpose to which they address, they would not be as suitable for the purposes of the present invention as heretofore described.

SUMMARY OF THE INVENTION

A primary object of the present invention is to provide a combined envelope and greeting card that will overcome the shortcomings of the prior art devices.

Another object is to provide a combined envelope and greeting card, so that a person does not have to worry about finding the right size envelope for the greeting card they want to mail.

An additional object is to provide a combined envelope and greeting card in which when folded and sealed the address and return address areas are printed directly thereon, so that a person can simply fill them out and mail it.

A further object is to provide a combined envelope and greeting card that is simple and easy to use.

A still further object is to provide a combined envelope and greeting card that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
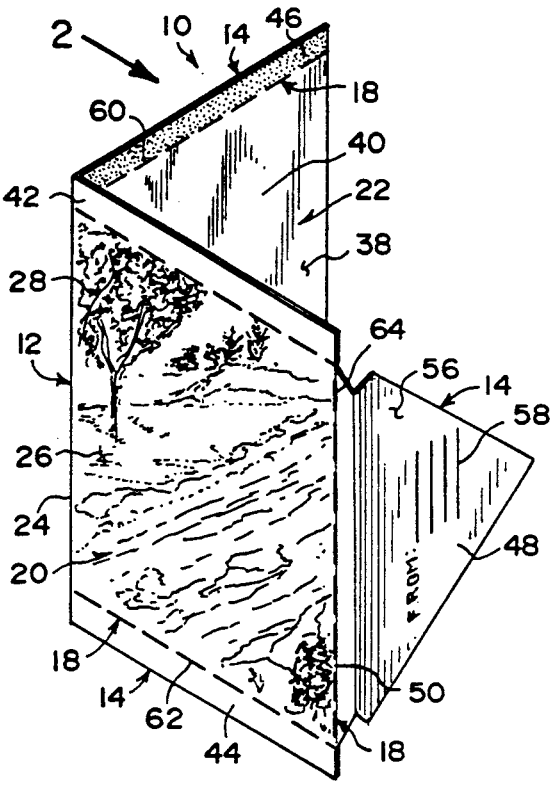
FIG. 1 is a perspective view of the instant invention partly opened.
Figure 2:
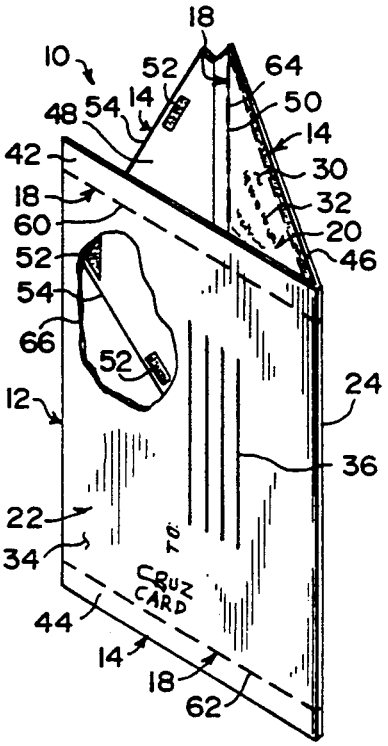
FIG. 2 is a perspective view taken in direction of arrow 2 in FIG. 1 with parts broken away.
Figure 3:
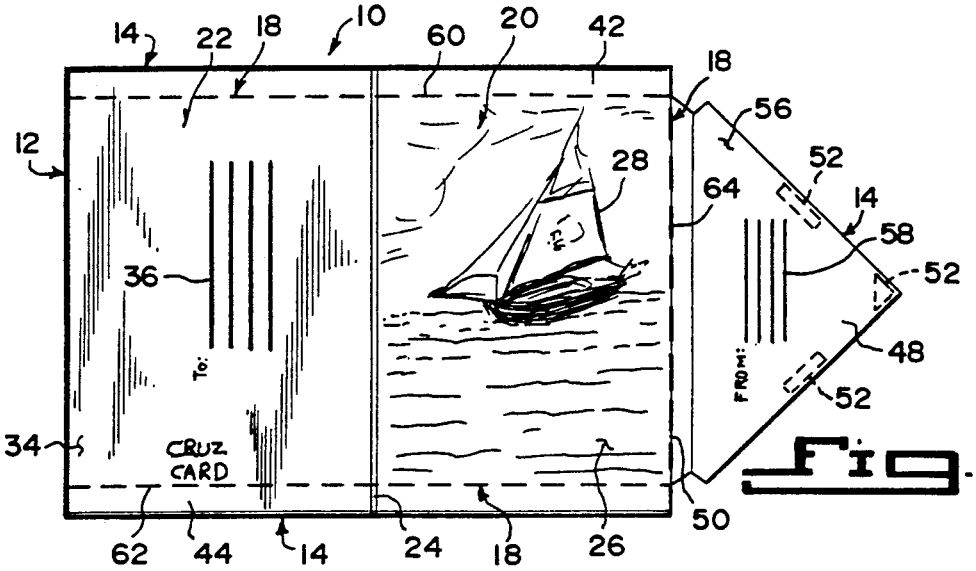
FIG. 3 is a front opened plan view thereof.
Figure 4:
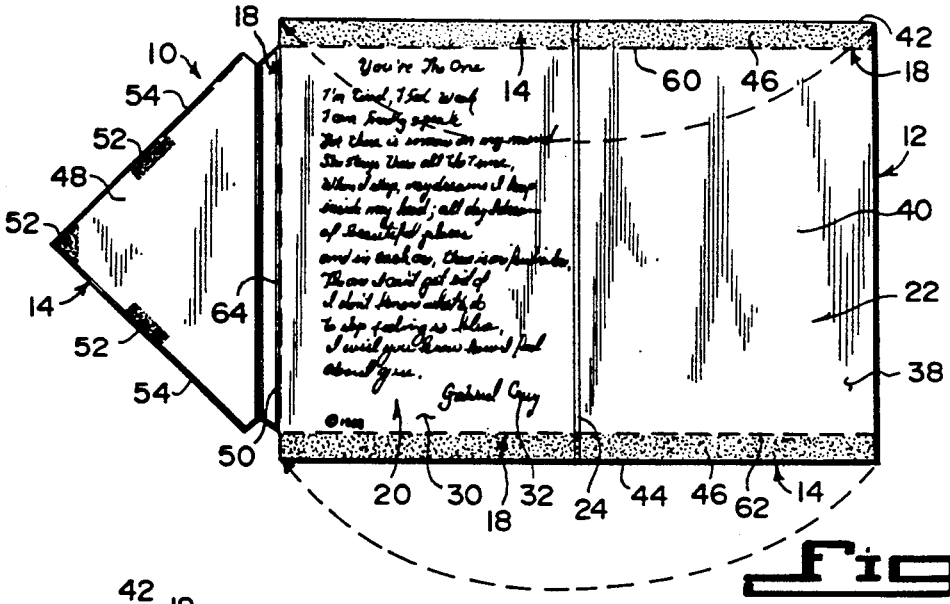
FIG. 4 is a rear opened plan view thereof.
Figure 6:
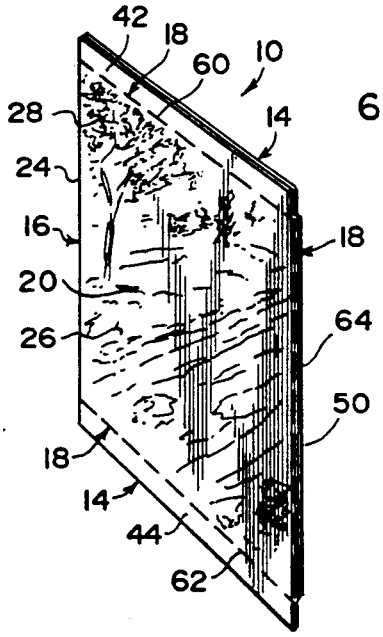
FIG. 6 is a perspective view taken in direction of arrow 6 in FIG. 5.
Figure 5:
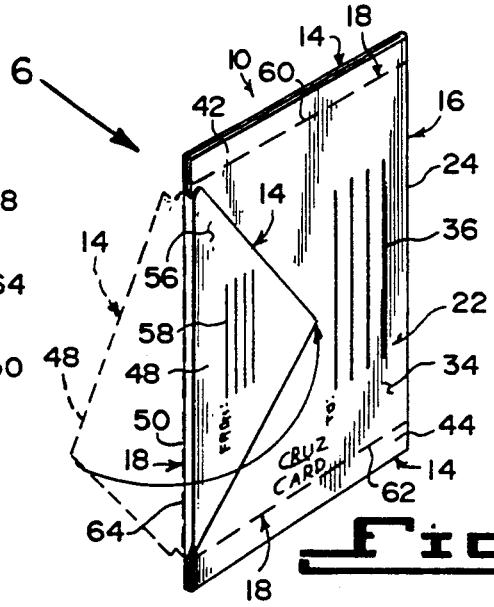
FIG. 5 is a perspective view of the instant invention folded closed and sealed.
Figure 7:
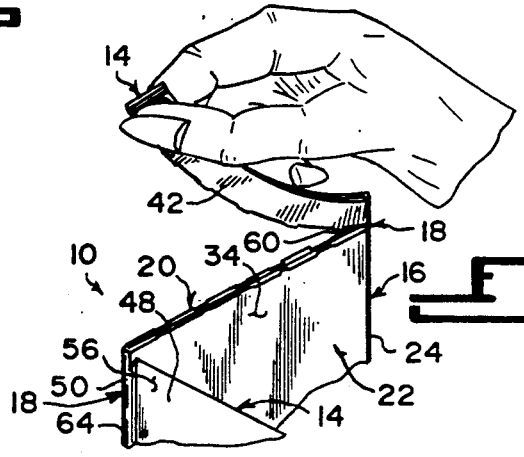
FIG. 7 is a partial perspective view similar to FIG. 5 showing one of the adhesive strips being removed therefrom.

Turning now descriptively to the drawings, in which similar reference characters denote similar elements throughout the several views, the Figures illustrate a combined envelope and greeting card 10 which consists of a greeting card configuration 12 and a mechanism 14 for sealing the greeting card configuration 12, so that it can be transformed into an envelope configuration 16 to be properly addressed by an addresser and then mailed to an addressee. A mechanism 18 is for breaking the sealing mechanism 14, so that the envelope configuration 16 can be transformed back into the greeting card configuration 12 by the addressee.

The greeting card configuration 12 includes a first panel member 20, a second panel member 22 and a fold spine 24 integral between the first panel member 20 and the second panel member 24, so that the first panel member 20 can be folded over the second panel member 22.

The first panel member 20 includes a front surface 26 having a picture 28 thereon and a rear surface 30 having indicia 32 thereon. The indicia 32 can include a saying, a poem, writing and the like.

The second panel member 22 includes a front surface 34 having a mailing address area 36 thereon for the addressee and a rear surface 38 having a blank space area 40 thereon for additional indicia.

The sealing mechanism 14 includes a pair of strip members 42, 44, each extending along opposite ends of the first panel member 20, the second panel member 22 and the fold spine 24. Adhesive material 46 is placed on the rear surfaces of the strip members 42, 44, so that when the greeting card configuration 12 is folded along the fold spine 24, the adhesive material 46 will come together to hold it closed as the envelope configuration 16.

The sealing mechanism 14 further includes a generally triangular closing flap 48 hinged integral along a fold line 50 to a side of the first panel member 20. A plurality of adhesive tabs 52 are spaced along the rear surface edges 54 of the closing flap 48. When the greeting card configuration 12 is folded along the fold spine 2 the adhesive tabs 52 will stick to the front surface 34 of the second panel member 22. The closing flap 48 includes a front surface 56 having a return address area 58 thereon for the addresser.

The mailing address area 36 on the front surface 34 of the second panel member 22 includes the word "TO:" printed thereon and a plurality of parallel lines for the name and address of the addressee to be placed thereon. The return address area 58 on the front surface 56 of the closing flap 48 includes the word "FROM:" printed thereon and a plurality of parallel lines for the name and address of the addresser to be placed thereon.

The breaking mechanism 18 includes a first set of perforations 60 extending between the first strip member 42 and along one end of the first panel member 20, the second panel member 22 and the fold spine 24. A second set of perforations 62 extend between the second strip member 44 and along an opposite end of the first panel member 20, the second panel member 22 and the fold spine 24. A third set of perforations 64 extend along the fold line 50 between the closing flap 48 and the side of the first panel member 20.

After the greeting card configuration 12 is folded into the envelope configuration 16, the first set of perforations 60 can be broken to remove the first strip member 42. The second set of perforations 62 can be broken to remove the second strip member 44. The third set of perforations 64 can be broken to allow the first panel member 20 and the second panel member 22 to be opened. The first panel member 20, the second panel member 22, the strip members 42, 44 and the closing flap 48 of the combined envelope and greeting card 10 are fabricated out of a durable thin cardboard material 66.

LIST OF REFERENCE NUMBERS

10 combined envelope and greeting card
12 greeting card configuration
14 sealing mechanism
16 envelope configuration
18 breaking mechanism
20 first panel member
22 second panel member
24 fold spine
26 front surface of 20
28 picture on 26
30 rear surface of 20
32 indicia on 30
34 front surface of 22
36 mailing address area on 34
38 rear surface of 22
40 blank space area on 38
42 first strip member
44 second strip member
46 adhesive material on 42, 44
48 closing flap
50 fold line
52 adhesive tab
54 rear surface edge of 48
56 front surface of 48
58 return address area on 56
60 first set of perforations
62 second set of perforations
64 third set of perforations
66 durable thin cardboard material It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A combined envelope and greeting card which comprises:

a) a greeting card configuration which includes;
  i) a first panel member;
  ii) a second panel member;
  iii) a fold spine integral between said first panel member and said second panel member, so that said first panel member can be folded over said second panel member.

b) means for sealing said greeting card configuration, so that it can be transformed into an envelope configuration to be properly addressed by an addresser and then mailed to an addressee, wherein said sealing means includes;
  i) a pair of strip members, each extending along opposite ends of said first panel member, said second panel member and said spine; and
  ii) adhesive material placed on the rear surfaces of said strip members, so that when said greeting card configuration is folded along said fold spine said adhesive material will come together to hold it closed as said envelope configuration; and
  iii) a generally triangular closing flap integrally hinged along a fold line to a side of said first panel; and
  iiii) a plurality of adhesive tabs spaced along the rear surface edges of said closing flap, so that when said greeting card configuration is folded along said fold spine said adhesive tabs will stick to the front surface of said second panel member; and c) means for breaking said sealing means, so that said envelope configuration can be transformed back into said greeting card configuration by the addressee.

2. A combined envelope and greeting card as recited in claim 1, wherein said first panel member includes:
a) a front surface having a picture thereon; and
b) a rear surface having indicia thereon.

3. A combined envelope and greeting card as recited in claim 2, wherein said indicia can include a saying, a poem, writing and the like.

4. A combined envelope and greeting card as recited in claim 3, wherein said second panel member includes:
a) a front surface having a mailing address area thereon for the addressee; and
b) a rear surface having a blank space area thereon for additional indicia.

5. A combined envelope and greeting card as recited in claim 4, wherein said closing flap includes a front surface having a return address area thereon for the addresser.

6. A combined envelope and greeting card as recited in claim 5, wherein said mailing address area on said front surface of said second panel includes:
a) the word "TO:" printed thereon; and
b) a plurality of parallel lines for the name and address of the addressee to be placed thereon.

7. A combined envelope and greeting card as recited in claim 6, wherein said return address area on said front surface of said closing flap includes:
a) the word "FROM:" printed thereon; and
b) a plurality of parallel lines for the name and address of the addresser to be placed thereon.

8. A combined envelope and greeting card as recited in claim 7, wherein said breaking means includes:
a) a first set of perforations extending between said first strip member and along one end of said first panel member, said second panel member and said fold spine;
b) a second set of perforations extending between said second strip member and along an opposite end of said first panel member, said second panel member and said fold spine; and
c) a third set of perforations extending along said fold line between said closing flap and the side of said first panel member, so that after said greeting card configuration is folded into said envelope configuration, said first set of perforations can be broken to remove said first strip member, said second set of perforations can be broken to remove said second strip member and said third set of perforations can be broken to allow said first panel member and said second panel member to be opened.

9. A combined envelope and greeting card as recited in claim 8, wherein said first panel member, said second panel member, said strip members and said closing flap are fabricated out of a durable thin cardboard material.

* * * * *